United States Patent [19]

Honda et al.

[11] Patent Number: 4,828,790

[45] Date of Patent: May 9, 1989

[54] INHIBITION OF DEPOSITION OF RADIOACTIVE SUBSTANCES ON NUCLEAR POWER PLANT COMPONENTS

[75] Inventors: Takashi Honda; Yasumasa Furutani, both of Katsuta; Kenya Ohashi, Hitachi; Eiji Kashimura, Ibaraki; Akira Minato, Hitachi; Katsumi Ohsumi, Hitachi; Hisao Itou, Hitachi, all of Japan

[73] Assignee: Hitachi, Ltd., Tokyo, Japan

[21] Appl. No.: 117,492

[22] Filed: Nov. 6, 1987

Related U.S. Application Data

[63] Continuation of Ser. No. 724,687, Apr. 19, 1985.

[30] Foreign Application Priority Data

Apr. 20, 1984 [JP] Japan ..... 78511
Jul. 4, 1984 [JP] Japan ..... 137210

[51] Int. Cl.[4] ..... G21C 11/02
[52] U.S. Cl. ..... 376/306; 148/287; 252/385
[58] Field of Search ..... 148/6.14 R; 252/385; 376/305, 306, 904; 427/5

[56] References Cited

U.S. PATENT DOCUMENTS

| | | | |
|---|---|---|---|
| 2,327,002 | 8/1943 | Thompson | 148/6,14 R |
| 2,837,474 | 6/1958 | Cartledge | 376/306 |
| 4,297,150 | 10/1981 | Foster et al. | 376/305 |
| 4,476,047 | 10/1984 | Bonnici et al. | 376/306 |
| 4,722,823 | 2/1988 | Honda et al. | 376/306 |

FOREIGN PATENT DOCUMENTS

| | | | |
|---|---|---|---|
| 1154132 | 9/1963 | Fed. Rep. of Germany | 148/6.14 R |
| 3227191 | 3/1984 | Fed. Rep. of Germany . | |
| 2010334 | 6/1983 | German Democratic Rep. . | |
| 1084597 | 4/1986 | Japan | 148/6.14 R |

OTHER PUBLICATIONS

Patent Abstracts of Japan, vol. 7, No. 11 (C-145) [1156] Jan. 18, 1983.

*Primary Examiner*—Deborah L. Kyle
*Assistant Examiner*—Richard W. Wendtland
*Attorney, Agent, or Firm*—Antonelli, Terry & Wands

[57] ABSTRACT

A nuclear power plant wherein surfaces of components contacting with nuclear reactor cooling water containing radioactive substances are coated with an oxide film, preferably being charged positively and/or containing chromium in an amount of 12% by weight or more, is prevented effectively from the deposition of radioactive substances thereon.

36 Claims, 10 Drawing Sheets

INHIBITION OF DEPOSITION OF RADIOACTIVE SUBSTANCES ON NUCLEAR POWER PLANT COMPONENTS

BACKGROUND OF THE INVENTION

This invention relates to a process for inhibiting deposition of radioactive substances on nuclear power plant components such as primary cooling water piping contacting with cooling water containing radioactive substances.

Piping, pumps, valves and the like (hereinafter referred to as "components") used in a primary cooling water system in a nuclear power plant are made of stainless steel, Stellite, etc. When these metals are used for a long period of time, they are corroded and damaged to release constituting metal elements into a nuclear reactor cooling water (hereinafter referred to as "cooling water"), which is sent to the interior of nuclear reactor. The released metal elements change into almost oxides, which deposit on fuel sticks and are exposed to neutron irradiation. As a result, there are produced radionuclides such as $^{60}Co$, $^{58}Co$, $^{51}Cr$, $^{54}Mn$, etc. These radionuclides are released in the primary cooling water again to become ions or to float as insoluble solids (herein after referred to as "crud") therein. A part of ions or crud is removed by a demineralizer for cleaning a reactor water, but the remainder deposits on surfaces of the components while circulating in the primary cooling water system. Thus, the dose rate at the surfaces of components increases, which results in causing a problem of exposure to irradiation of workers at the time of inspection or for maintenance.

There have been proposed various processes for inhibiting the release of these metal elements which is a source of such a problem in order to lower the deposition of radiactive substances. For example, materials having good corrosion resistance are used, or oxygen is introduced into a water supply system in order to inhibit the corrosion of the components. But the corrosion of components of the water supply system and primary cooling water system cannot be inhibited sufficiently and the amount of radioactive substances in the primary cooling water cannot be reduced sufficiently, even if any processes are used. Therefore, the increase of dose rate at the surfaces of components due to the deposition of radioactive substances still remains as a problem.

On the other hand, various methods for removing deposited radioactive substances on the components have been studied and practically used. These methods can be divided into (1) mechanical cleaning, (2) electrolytic cleaning and (3) chemical cleaning. The methods of (1) and (2) are difficult to remove radioactive substances adhered to the component surfaces strongly, and cannot be used for systematic decontamination in a broad range. Therefore, the method (3) is widely used today. According to the method (3), a reagent solution such as an acid solution is used to dissolved an oxide film on steel surface by chemical reaction and to remove radioactive substances present in the oxide film. But there is a problem in the method (3) in that even if the dose rate may be reduced temporally, the components are rapidly contaminated again when exposed to a solution dissolving radioactive substances in high concentration.

In order to remove such a problem, there is proposed a process for inhibiting the deposition of radioactive substances by forming an oxide film on component surfaces previously (e.g. Japanese Patent Application Nos. 28976/79 and 146111/82). But according to this process, deposition behavior of radioactive substances changes remarkably depending on properties of oxide films previously formed. For example, behavior of radioactive ions is different depending on charged state of an oxide film previously formed, and the growth rate of oxide film newly formed on component surfaces after immersion in a solution for dissolving radioactive substances changes depending on properties of oxide film originally formed. Therefore, it is necessary to conduct an oxidation treatment of the components by a process best suited for applying solution.

SUMMARY OF THE INVENTION

It is an object of this invention to solve a problem of exposure to irradiation of workers for maintenance and inspection of nuclear power plants by reducing the deposited amount of radioactive substances on the component surfaces contacting with cooling water containing the radioactive substances.

This invention provides a process for inhibiting deposition of radioactive substances on nuclear power plant components which comprises forming oxide films, which are charged positively or contain chromium in an amount of 12% by weight or more on surfaces of components contacting with nuclear reactor cooling water containing radioactive substances.

DESCRIPTION OF THE PREFERRED EMBODIMENTS

Figure 1:
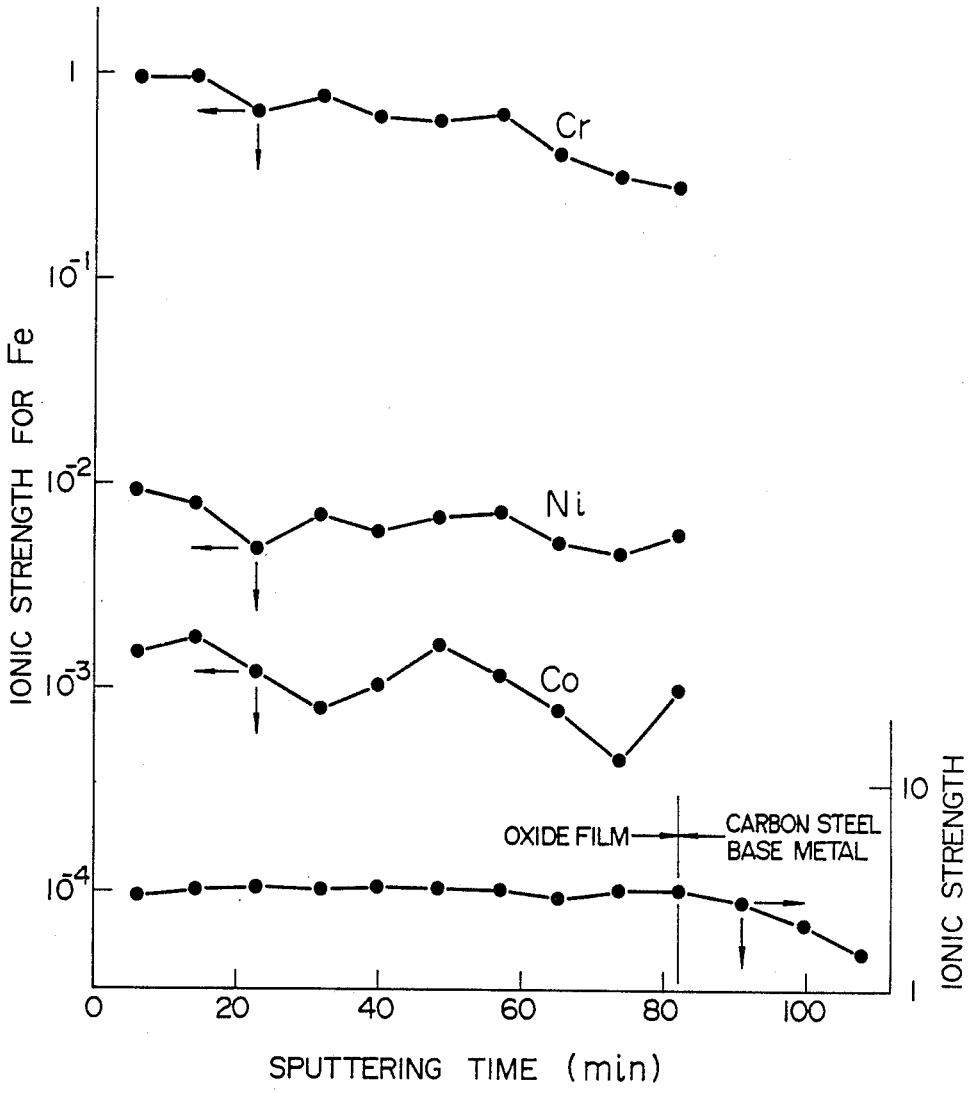
FIG. 1 is a graph showing distribution of elements in carbon steel oxide film.

Radionuclides dissolved in the reactor water are incorporated in an oxide film in the course of its formation on the surface of components made of stainless steel by corrosion [e.g., T. Honda et al: Nucl. Technol., 64, 35 (1984)]. According to the study of the present inventors, an oxide film mainly grows in an inner direction (a matrix metal side) at an interface of the oxide film and the matrix metal in high temperature water, and radionuclides transfer by diffusion in the inner direction in the oxide film and then are incorporated in the oxide film at the same interface. The flux ($J_0$) of radionuclides can be represented by the following equation:

$$J_0 = \frac{k_0 D(C_1 - C_2)}{d} \quad (1)$$

wherein d = the thickness of oxide film $k_0$ = the constant of proportionality

D = the diffusion coefficient $C_1$ = the concentration of radionuclides in the reactor water $C_2$ = the concentration of radionuclides at the interface of oxide film/metal Since the thickness of oxide film (d) is a product of the constant of proportionality ($k_1$) and the amount of the oxide film (m), i.e., $$d = k_1 m \quad (2)$$

$J_o$ can be represented by the following equation:

$$J_0 = \frac{k_0 D(C_1 - C_2)}{k_1 m} \quad (3)$$

On the other hand, the rate of incorporation of radionuclides in the oxide film ($J_1$) can be represented by the equation (4) using the growth rate of oxide film (dm/dt):

$$J_1 = k_2 C2 \left(\frac{dm}{dt}\right) \quad (4)$$

wherein $k_2$ = the constant of proportionality Since the accumulation rate of radionuclides (J) is $J = J_0 = J_1$, J can be represented by the equation (5) by eliminating $C_2$ from the equations (3) and (4):

$$J = \frac{k_0 k_2 D\left(\frac{dm}{dt}\right) C_1}{k_1 k_2 m\left(\frac{dm}{dt}\right) + k_0 D} \quad (5)$$

When the accumulation of radionuclides is rate-determined in the course of diffusion, J can be represented by the following equation:

$$J = \frac{k_0 D C_1}{k_1 m} \quad (6)$$

The equation (6) shows that the accumulation rate (J) is proportional to the diffusion coefficient (D) and means that if the diffusion of radionuclides in the oxide film is inhibited, the accumulation can be inhibited.

Therefore, the inhibition of accumulation of radionuclides can be attained by the inhibition of diffusion of radionuclides in the oxide film. This invention is based on such a finding.

Major radionuclides contributing to the dose rate are $^{60}Co$ and $^{58}Co$, which are present in the cooling water as cations. The oxide surface is hydrolyzed in the solution and charged positively or negatively depending on the pH of the solution as shown in the equations (7) and (8):

$$Fe(OH)_2^+ + 2H_2O \rightleftharpoons Fe(OH)_3 + H_3O^+ \quad (7)$$

$$Fe(OH)_3 \rightleftharpoons FeO_2^- + H_3O^+ \quad (8)$$

[see G. A. Parks and P. L. de Bruyn: J. Phys. Chem., 66, 967 (1962)].

Therefore, when the oxide film formed on the component surfaces is positively charged in the cooling water, diffusion of cations of $^{60}Co$ and $^{58}Co$ in the oxide film can be inhibited, since the oxide film has selective transmission of anions. The pH at electrically neutral state of the oxide surface is defined as a zero point of charge (ZPC). When the pH of the solution is higher than ZPC, the oxide is charged negatively, while when the pH of the solution is lower than ZPC, the oxide is charged positively. Therefore, oxides of ZPC>7 are charged positively in neutral water (pH=about 7) such as cooling water used in a boiling water reactor plant (hereinafter referred to as "BWR plant").

The present inventors have found that when carbon steel, stainless steel, etc. are subjected to an oxidation treatment in a solution containing polyvalent metal cations and anions having a smaller ionic valence number than the cations, for example a solution of $Ca(NO_3)_2$, an oxide film of ZPC>7 can be formed. When such an iron oxide film is formed, the accumulation of radionuclides can be inhibited even if contacted with reactor cooling water. This treating method can be applied whether an iron oxide film is present on the surfaces of components or not. For example, as to stainless steel used in a nuclear power plant in operation, such an object can be attained by pouring a solution containing polyvalent cations and anions having a smaller ionic valence number than the cations into the cooling water. In such a case, the diffusion of cations such as $^{60}Co$, etc. into the oxide film can be inhibited and the accumulation of the cations can also be inhibited.

As the polyvalent cations, there can be used at least one member selected from the group consisting of $Al^{3+}$, $Fe^{3+}$, $Ba^{2+}$, $Ca^{2+}$, $Co^{2+}$, $Mg^{2+}$, $Ni^{2+}$, $Pb^{2+}$, $Zn^{2+}$ and $Ca^{2+}$. As the anions having a smaller ionic valence number than the cations, there can be used at least one member selected from the group consisting of $HCO_3^-$, $H_2PO_4^-$, $MnO_4^-$, $NO_2^-$, $NO_3^-$, $OH^-$, $HCOO^-$, $CH_3COO^-$, $MoO_4^{2-}$, $HPO_4^{2-}$, $SO_4^{2-}$ and $WO_4^{2-}$.

The temperature is preferably 150° to 300° C.

The concentration of the cations is preferably 3 ppb to 1000 ppm, more preferably 3 to 100 ppb.

Usually polyvalent cations as listed in Table 1 are present in the cooling water.

TABLE 1

| Ions | Maximum concentration (ppb) |
|---|---|
| $Ni^{2+}$ | 0.5 |
| $Co^{2+}$ | 0.05 |
| $Zn^{2+}$ | 0.5 |
| $Cu^{2+}$ | 0.5 |

[Y. Yuasa: J. Nucl. Sci. Technol., 17, 564 (1980)]

Therefore, a method of coating the components with an oxide film which can easily adsorb these cations previously is also effective. The present inventors have found that an oxide film formed by treating stainless steel under a weakly oxidizing or reducing atmosphere can satisfy such a condition. The oxide film formed under such conditions have many lattice defects, which become centers of activity and thus show strong adsorbing capacity. As a result, the oxide film is positively charged and inhibit the diffusion of $^{60}Co$ and the like into the oxide film by showing selective transmission of anions.

The oxidation treatment conditions can be obtained by deaeration so as to make the concentration of dissolved oxygen 10 ppb or less, or the addition of a reducing agent.

Examples of the reducing agent are hydrogen, hydrazine, L-ascorbic acid, formaldehyde, oxalic acid, etc. Further, it is also possible to use substances which do not particularly show reducing properties at normal temperatures but can act as a reducing agent at high temperatures. Many organic reagents belong to such substances. That is, organic compounds decompose at high temperatures and special organic compounds act as a reducing agent at such a time. Such special organic compounds are required to be soluble in water and to be decomposed at 300° C. or lower. Further such special organic compounds should not contain elements such as a halogen and sulfur which corrode the matrix such as stainless steel. These elements are possible to cause pinholes and stress cracking by corroding matrix stainless steel. Examples of such organic compounds are organic acids such as oxalic acid, citric acid, acetic acid, formic acid, etc.; chelating agents such as ethylenediaminetetraacetic acid (EDTA), nitrilotriacetic acid (NTA), etc. Since these compounds are acidic and very corrosive to the matrix as they are, it is necessary to adjust the pH to 5 to 9 with an alkaline agent such as ammonia, sodium hydroxide, or the like so as to make them neutral or weakly alkaline. Needless to say, salts of these compounds near neutral such as 2-ammonium citrate, EDTA-$2NH_4$, etc., can be used by simply dissolving them in water. The use of chelating agent such as EDTA, NTA, or the like is particularly preferable, since the chelating agent not only shows reducing properties by decomposition at high temperatures, but also accelerates the dissolution of iron oxide by stabilizing iron ions by chelating so as to finally produce an oxide film having a high chromium content.

These organic reducing agents are preferably used in a concentration of 10 ppm to 1% by weight, more preferably 100 to 3000 ppm. If the concentration is too low, no effect is obtained, whereas if the concentration is too high, there takes place incomplete decomposition at high temperatures so as to produce a large amount of sludge which undesirably deposits on piping.

The preferable temperature is 150°-300° C.

Another method for inhibiting the accumulation of radionculides in the oxide film is to inhibit the incorporation of radionuclides into the oxide film.

The radionuclides dissolved in the cooling water is incorporated into the oxide film in the course of its formation on the surface of stainless steel by the corrosion thereof. According to the study of the present inventors, there is the correlation between the deposition rate of radionuclides and the film growth rate. Therefore, it was estimated that the inhibition of film growth resulted in lowering in the deposition.

The increase of the film amount (m) of stainless steel under circumstances of cooling water can be represented by a logarithm of time as shown below:

$$m = a \log t + b \quad (9)$$

wherein a and b are constants.

That is, the growth rate is reduced with the growth of film. Therefore, if a suitable non-radioactive oxide film is formed previously, new formation of film after the immersion in a liquid dissolving radioactive substances can be inhibited. Further, the deposition of radioactive substances taking place at the time of film formation can be inhibited.

The present inventors have noticed that the inhibition of deposition of radioactive substances can be attained by previously forming a suitable non-radioactive oxide film on metal components used in contact with the reactor cooling water dissolving the radioactive substances. At the same time, the present inventors have found that the depositiomn rate of $^{60}Co$ is dependent on the chromium content in the oxide film previously formed and the deposition rate becomes remarkably small, particularly when the chromium content in the metals constituting the oxide film is 12% by weight or more.

Another feature of this invention is based on such a finding. That is, the oxide film previously formed on the surfaces of components contacting with the liquid dissolving radioactive substances contains 12% by weight or more of chromium. By forming the oxide film having such a high chromium content and being positively charged in the reactor cooling water, the deposition of radioactive substances can further be inhibited.

The proportion of chromium in the total metals constituting the oxide film (hereinafter referred to as "chromium content") is sufficient when 12% by weight or more. When applied to the BWR plant wherein the cooling water contains about 200 ppb of oxygen, the chromium content in the oxide film gradually decreases due to the oxidation of the chromium in the oxide film to give soluble chromium having a valence number of 6. Therefore, it is desirable to make the chromium content in the oxide film previously formed as high as possible.

The oxide film having a chromium content of 12% by weight or more, preferably a remarkably high chromium content, can previously be formed by oxidizing a high chromium content matrix in water at high temperatures, e.g. 150°-300° C. as it is. In the case of carbon steel and low alloy steel, it is difficult to form the oxide film by oxidation in the high temperature water. Further, in the case of 18 Cr—8 Ni stainless steel usually used in nuclear power plants, the chromium content becomes 20% by weight or less when simply oxidized in high temperature water. Therefore, when there is used a raw material which is difficult to form a high chromium content oxide film by simple oxidation in high temperature water, the oxide film having a high chromium content can be formed by covering the surface with a metal coating containing a large amount (about 50% by weight) of chromium, and then oxidizing in water at high temperatures such as 150°-300° C. or in steam at high temperatures such as 150° to 1000° C. The metal coating containing a large amount of chromium can be formed by a conventional method, preferably by a chromium plating method, a chromizing treatment, a chromium vapor deposition method, and the like.

On the other hand, when stainless steel is oxidized in water at high temperatures, it is possible to form the oxide film having a chromium content of near 20% by weight. But when such an oxide film is used in the cooling water containing oxygen in the BWR plant mentioned above, the chromium content is gradually lowered due to oxidation to give soluble chromium having a valence number of 6. In such a case, it is desirable to form an oxide film having a higher chromium content previously. This can be attained by carrying out the oxidation in high temperature water containing a reductive substance.

The formation of oxide film having such a high chromium content by the above-mentioned method can be explained by the following principle.

There are two kinds of oxides of chromium, i.e. chromic oxide ($Cr_2O_3$) and chromium trioxide ($CrO_3$). Chromic oxide is hardly soluble in water, but chromium trioxide is soluble in water. Therefore, oxides of chromium become easily soluble in water under oxidizing circumstances and hardly soluble in water under reducing circumstances. In the case of iron, there are ferrous oxide and ferric oxide. Ferrous oxide is more soluble in water than ferric oxide. Therefore, oxides of iron become more easily soluble in water under reducing circumstances than under oxidizing circumstances. Therefore, when stainless steel containing chromium and iron is oxidized under reducing circumstances, since the iron becomes easily soluble in water and the chromium remains as oxide on the surface of the matrix to form the oxide film having a high chromium content. Even under such reducing circumstances, iron and chromium can be oxidized at high temperatures so long as water is present.

The reducing circumstances can be formed by adding a reducing agent to water. Examples of the reducing agent are hydrogen, hydrazine, L-ascorbic acid, formaldehyde, oxalic acid, etc. Further, it is also possible to use substances which do not particularly show reducing properties at normal temperatures but can act as a reducing agent at high temperatures. Many organic reagents belong to such substances. That is, organic compounds decompose at high temperatures and special organic compounds act as a reducing agent at such a time. Such special organic compounds are required to be soluble in water and to be decomposed at 300° C. or lower. Further such special organic compounds should not contain elements such as a halogen and sulfur which corrode the matrix such as stainless steel. These elements are possible to cause pinholes and stress corrosion cracking by corroding matrix stainless steel. Examples of such organic compounds are organic acids such as oxalic acid, citric acid, acetic acid, formic acid, etc.; chelating agents such as ethylenediaminetetraacetic acid (EDTA), nitrilotriacetic acid (NTA), etc. Since these compounds are acidic and very corrosive to the matrix as they are, it is necessary to adjust the pH to 5 to 9 with an alkaline agent such as ammonia, sodium hydroxide, or the like so as to make them neutral or weakly alkaline. Needless to say, salts of these compounds near neutral such as 2-ammonium citrate, EDTA-$2NH_4$, etc., can be used by simply dissolving them in water. The use of chelating agent such as EDTA, NTA, or the like is particularly preferable, since the chelating agent not only shows reducing properties by decomposition at high temperatures, but also accelerates the dissolution of iron oxide by stabilizing iron ions by chelating so as to finally produce an oxide film having a high chromium content.

These organic reducing agents are preferably used in a concentration of 10 ppm to 1% by weight, more preferably 100 to 3000 ppm. If the concentration is too low, no effect is obtained, whereas if the concentration is too high, there takes place incomplete decomposition at high temperatures so as to produce a large amount of sludge which undesirably deposits on piping.

In the chemical decontamination of nuclear power plants, a decontamination solution containing at least one reagent selected from an organic acid, a chelating agent and a reducing agent is generally used. In order to inhibit a rapid contamination progress after the decontamination, the above-mentioned process is particularly preferable. That is, since the decontamination solution contains the above-mentioned organic compounds, it can be used for the purpose of this invention as it is. But since the decontamination solution after decontamination contains radionuclides such as $^{60}Co$ mainly, it cannot be heated as it is due to deposition of $^{60}Co$. Therefore, the abovementioned treatment can be conducted after removing the used decontamination solution, or after removing radionuclides such as $^{60}Co$ from the decontamination solution by using a cation exchange resin or electrodeposition, the decontamination solution is heated and the oxide film is formed. When the pH of decontamination solution after decontamination is low, it is adjusted to near neutral by adding an alkaline agent such as ammonium thereto. Further, when the concentration of the organic compounds is too high to conduct the oxidation treatment, a part of the solution is taken out and the solution can be diluted by adding water thereto, or a part of the solution is passed through an ion exchange resin, so as to lower the concentration to the desired value.

This invention is illustrated by many of the following Examples, in which all percents are by weight unless otherwise specified.

Example 1

Plant component materials made of carbon steel (STPT 42) and stainless steel (SUS 304) having chemical compositions shown in Table 2 were immersed in a cooling water dissolving oxygen in a concentration of 150–170 ppb at a flow rate of 0.5 m/sec at 230° C. for 1000 hours.

TABLE 2

| Plant component material | Chemical composition (%) | | |
|---|---|---|---|
| | Co | Ni | Cr |
| STPT 42 | 0.0063 | 0.022 | 0.012 |
| SUS 304 | 0.22 | 9.11 | 18.1 |

Figure 2:
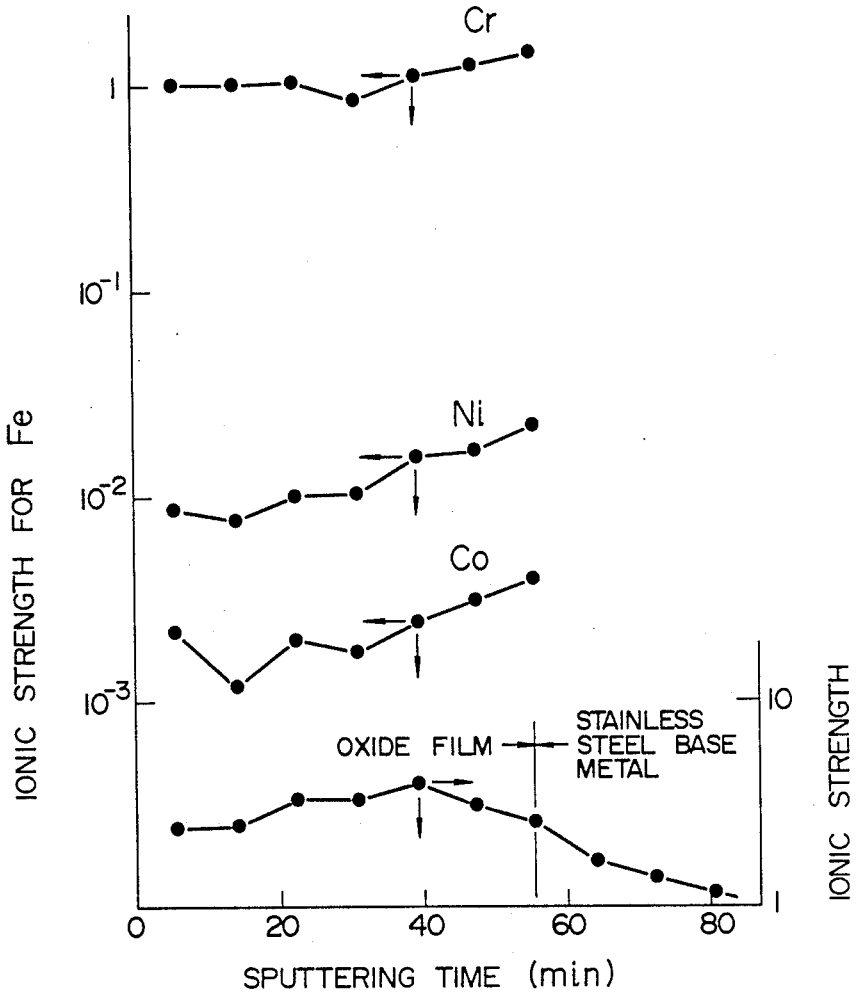
FIG. 2 is a graph showing distribution of elements in stainless steel oxide film.

Then, the resulting oxide films were analyzed by secondary ion mass spectroscopy (SIMS). The results are shown in FIGS. 1 and 2.

Distribution of the elements in the thickness direction of oxide film in the case of carbon steel shows that Co, Ni and Cr decrease their concentrations from the surface of the oxide film to the matrix metal. The carbon steel (STPT 42) contains Co, Ni and Cr in very small amounts in the matrix as shown in Table 2, but the contents of these elements in the oxide film are ten to hundred times higher than the original contents as shown in Table 3. Therefore, these elements seem to be incorporated not from the matrix metal but from the cooling water. Further, the oxide film grew at a constant rate with the lapse of time.

TABLE 3

| | Chemical composition (%) | | |
|---|---|---|---|
| | Co | Ni | Cr |
| Oxide film | 0.0236 | 1.45 | 2.95 |

More in detail, the oxide film grows to the inner direction at the interface of the oxide film and the matrix metal. On the other hand, the above-mentioned three elements present in the cooling water transmit through the oxide film and reach the above-mentioned interface, and then are incorporated in the growing oxide film.

The above-mentioned phenomena can be represented by the following equation; that is, the concentration of ions of elements at the interface of oxide film/metal ($C_2$) can be represented as follows by using the equations (3) and (4):

$$C_2 = \frac{k_0 D C_1}{k_1 k_2 m \left(\frac{dm}{dt}\right) + k_0 D} \quad (10)$$

When the diffusion coefficient (D) of ions is small and the incorporation of ions in the oxide film is controlled by the diffusion, the equation (10) can be simplified as the following equation:

$$C_2 = \frac{k_0 D C_1}{k_1 k_2 m \left(\frac{dm}{dt}\right)} \quad (11)$$

Therefore, when the growing rate of oxide film (dm/dt) is constant, the concentration of ions of elements at the interface of oxide film and matrix metal ($C_2$) decreases in order to increase the oxide film amount (m) with the lapse of time; this is in good agreement with the results of SIMS.

In the case of stainless steel (SUS 304), concentrations of Ni and Cr in the oxide film are lower than those of the matrix as shown in Table 4.

TABLE 4

| | Chemical composition (%) | | |
|---|---|---|---|
| | Co | Ni | Cr |
| Oxide film | 0.29 | 3.07 | 7.6 |

Since Ni and Cr are major elements constituting stainless steel, these elements incorporated in the oxide film seem to be derived from the elements released from the matrix metal by corrosion. FIG. 2 shows a tendency to increase the concentrations of individual elements in the thickness direction of the oxide film. This seems to be that the diffusion of the released elements in the outer direction is prevented by the oxide film, the ion concentrations of these elements at the interface of oxide film/metal increase with the lapse of time, and the oxide film grows at the same interface.

As mentioned above, the oxide films of stainless steel and carbon steel clearly grow in the inner direction of the matrix metal in high temperature water. Therefore, radionuclides dissolved in the cooling water seem to transfer in the oxide film by diffusion and to be incorporated in the oxide film at the interface and accumulated.

Example 2

Stainless steel (SUS 304) powder and iron powder were subjected to oxidation treatment in a solution of pure water and $Ca(NO_3)_2$ with calcium ion concentration of 50 ppb at 230° C. for 100 hours.

Figure 3:
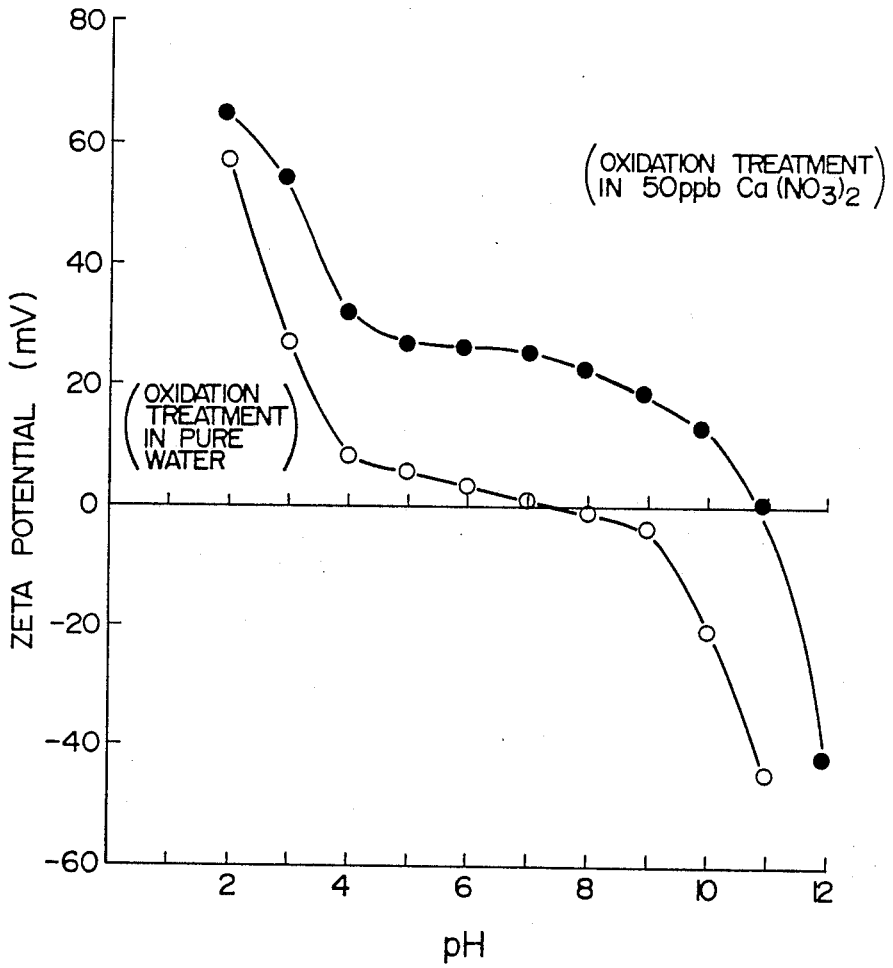
FIG. 3 is a graph showing a relationship between the zeta potential and pH of stainless steel oxide.
Figure 4:
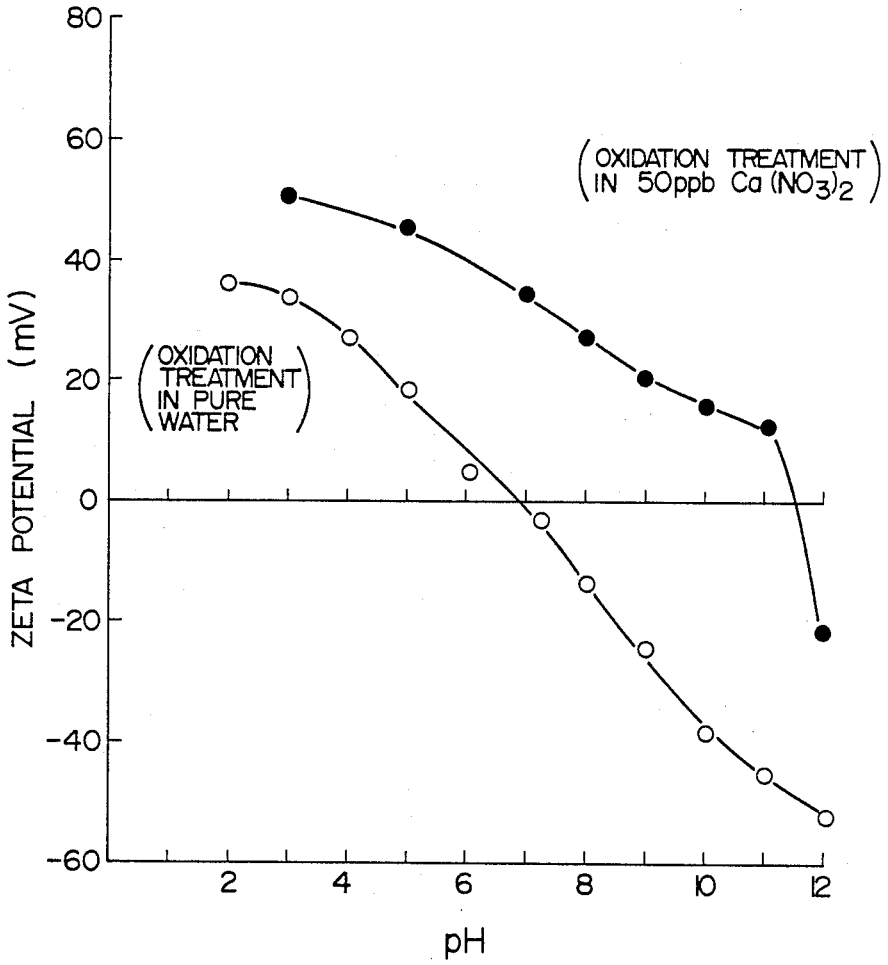
FIG. 4 is a graph showing a relationship between the zeta potential and pH of iron oxide.

FIG. 3 shows the results of zeta potential of stainless steel powder after the oxidation treatment and FIG. 4 shows those of iron powder after the oxidation treatment. Table 5 shows ZPC of individual oxides.

TABLE 5

| Powder | Treating conditions | ZPC |
|---|---|---|
| Stainless steel | In pure water | 7 |
| | In aq. solution of $Ca(NO_3)_2$ ($Ca^{2+}$, 50 ppb) | 11 |
| Iron | In pure water | 7 |
| | In aq. solution of $Ca(NO_3)_2$ ($Ca^{2+}$, 50 ppb) | 11.5 |

As is clear from Table 5, when stainless steel and iron are subjected to the oxidation treatment in pure water, ZPC is 7 in each case, while when subjected to the oxidation treatment in the aqueous solution of $Ca(NO_3)_2$, ZPC is 11 in the case of stainless steel and 11.5 in the case of iron, and the resulting oxidized products are charged positively in neutral water (pH 7).

Therefore, when subjected to the oxidation treatment in a solution containing a combination of divalent cation $Ca^{2+}$ and monovalent anion $NO_3^-$ (i.e. in $Ca(NO_3)_2$ solution), it becomes clear that the oxide film is charged positively in neutral water, shows anion selective transmission, and inhibits transmission of cations such as $^{60}Co$ in the cooling water.

The combination of a polyvalent metal cation and an anion having a lower valence number than the cation can be selected optionally. But considering problems of corrosion of materials such as stress cracking by corrosion, toxicity, etc., the combination I or II shown in Table 6 is preferable.

TABLE 6

| Combination | Polyvalent metal cation | Anion |
|---|---|---|
| I | $Al^{3+}$, $Fe^{3+}$, $Ba^{2+}$, $Ca^{2+}$, $Co^{2+}$, $Mg^{2+}$, $Ni^{2+}$, $Pb^{2+}$, $Zn^{2+}$, $Cu^{2+}$ | $HCO_3^-$, $H_2PO_4^-$, $MnO_4^-$, $NO_2^-$, $NO_3^-$, $OH^-$, $HCOO^-$, $CH_3COO^-$ |
| II | $Al^{3+}$, $Fe^{3+}$ | $MoO_4^{2-}$, $HPO_4^{2-}$, $SO_4^{2-}$, $WO_4^{2-}$ |

The concentrations of these ions are not critical and can be usable up to the saturated solubility of chemical substances mentioned above. But when the concentrations are too high, there arises a problem of corrosion of the material. Therefore, the concentration of 3 ppm to 1000 ppm is generally preferable.

The temperature for the oxidation treatment is preferably 150° C. or higher, more preferably 200° to 300° C., since too low temperature for the oxidation treatment takes a longer time for the growth of oxide film.

The thickness of the oxide film is preferably 300 Å or more.

Example 3

Figure 5:
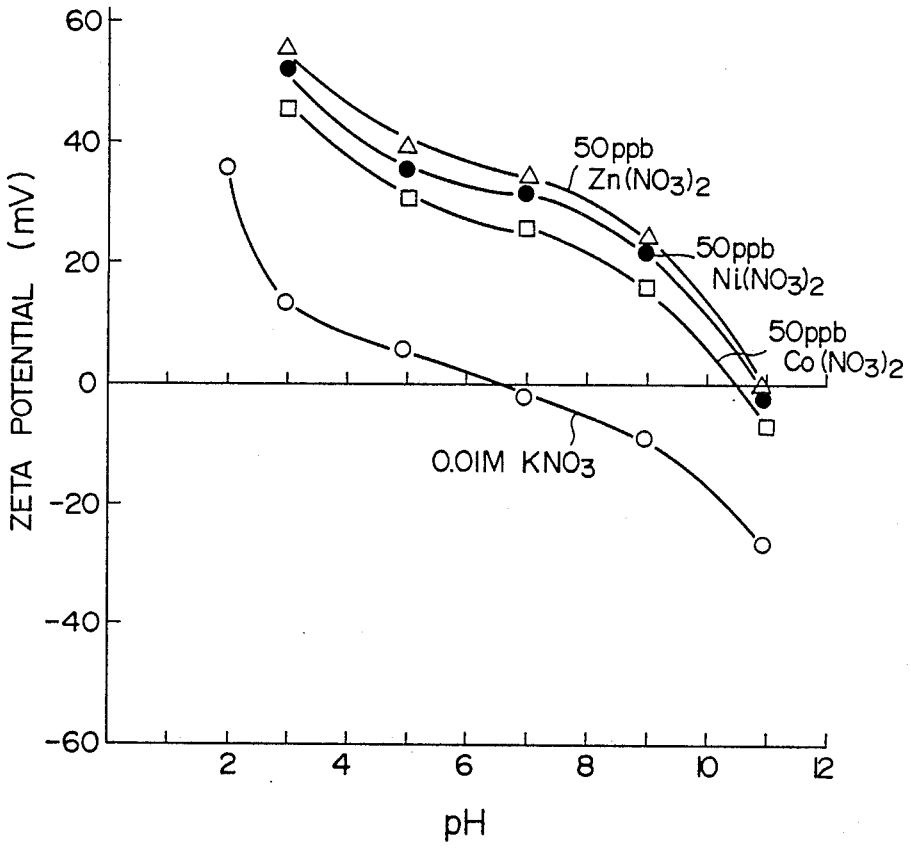
FIG. 5 is a graph showing a relationship between the zeta potential and pH of stainless steel oxide.
Figure 6:
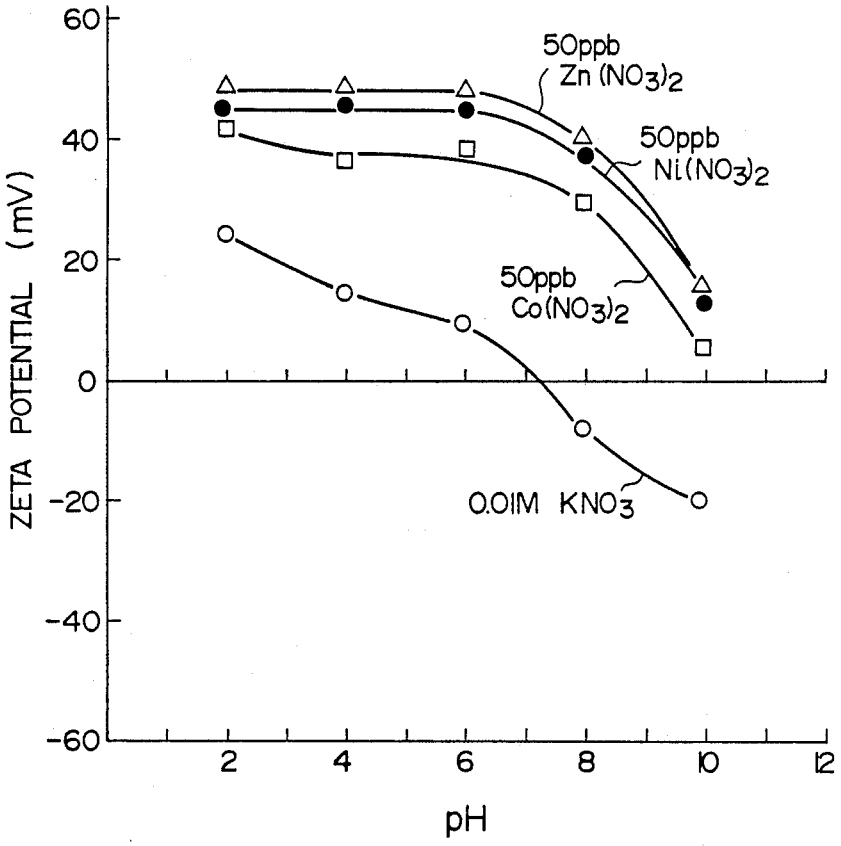
FIG. 6 is a graph showing a relationship between the zeta potential and pH of iron oxide.

Stainless steel (SUS 304) powder and iron powder were subjected to oxidation treatment in deaerated neutral pure water at 288° C. for 100 hours. Then, zeta potentials of the thus treated materials were measured in a $KNO_3$ solution (0.01M, outside of this invention), or in nitrate solutions of $Co^{2+}$, $Ni^{2+}$, and $Zn^{2+}$ in concentrations of 50 ppb as divalent cations. The results are shown in FIGS. 5 and 6.

X-ray diffraction of the resulting oxide films formed on the surfaces of stainless steel and iron revealed that they were magnitude ($Fe_3O_4$).

In each case, the zeta potential transfered to the positive direction in the presence of polyvalent metal cations and took the positive value in neutral water.

Example 4

After immersing stainless steel having a chemical composition as shown in Table 7 in the cooling water flowing at a rate of 0.5 m/sec for 1000 hours at 230° C., the amount of oxide film and the deposited $^{60}Co$ amount were measured.

TABLE 7

| | Chemical composition (%) | | | | | | | |
|---|---|---|---|---|---|---|---|---|
| | C | Si | Mn | S | Ni | Cr | Co | P |
| SUS 304 | 0.06 | 0.76 | 1.12 | 0.023 | 9.11 | 18.07 | 0.22 | 0.029 |

Before the immersion, the stainless steel was subjected to mechanical processing on the surface, degreasing and washing. The cooling water continued $^{60}Co$ in a concentration of $1\times10^{-4}$ μCi/ml and 90% or more of $^{60}Co$ was present as ions, dissolved oxygen in a concentration of 150–170 ppb, and had a temperature of 230° C. and a pH of 6.9–72.

In this Example, the stainless steel was subjected to oxidation treatment by immersing it in flowing pure water at 285° C. having a dissolved oxygen concentration of 200 ppb or less and an electrical conductivity of 0.1 μS/cm for 50 to 500 hours to previously form an oxide film having a chromium content of 12% or more.

Figure 7:
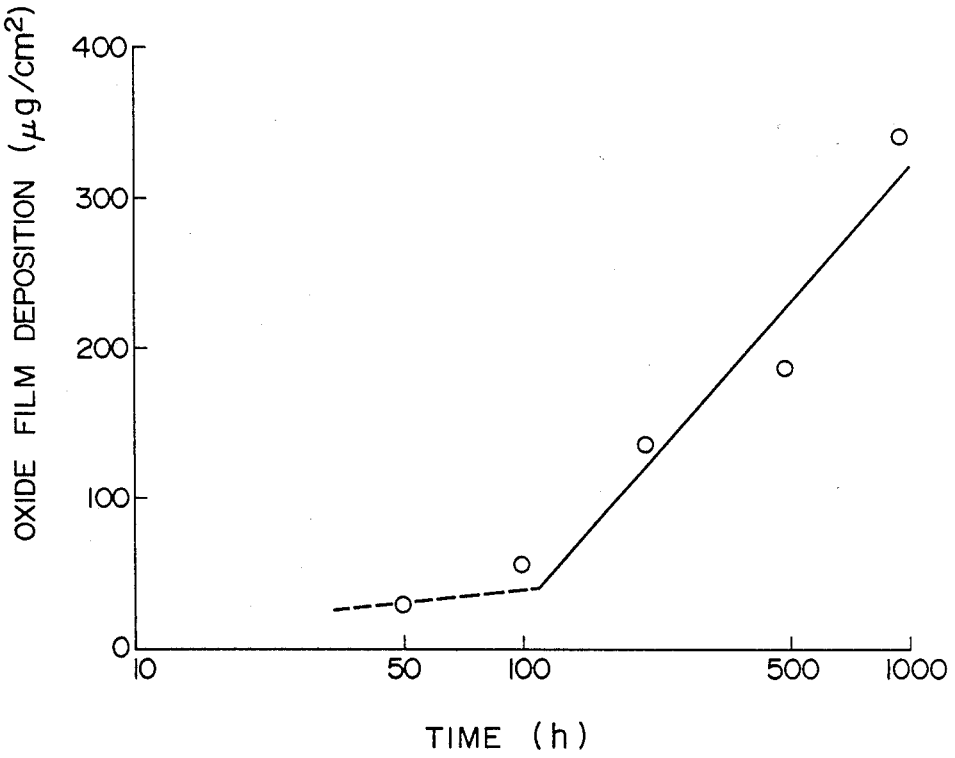
FIG. 7 is a graph showing a relationship between the stainless steel oxide film amount and the time.

FIG. 7 shows the change of amount of typical elements in the oxide film (as a total of Fe, Co, Ni and Cr) with the lapse of time. As is clear from FIG. 7, the amount increases according to a rule of logarithm after 100 hours.

Figure 8:
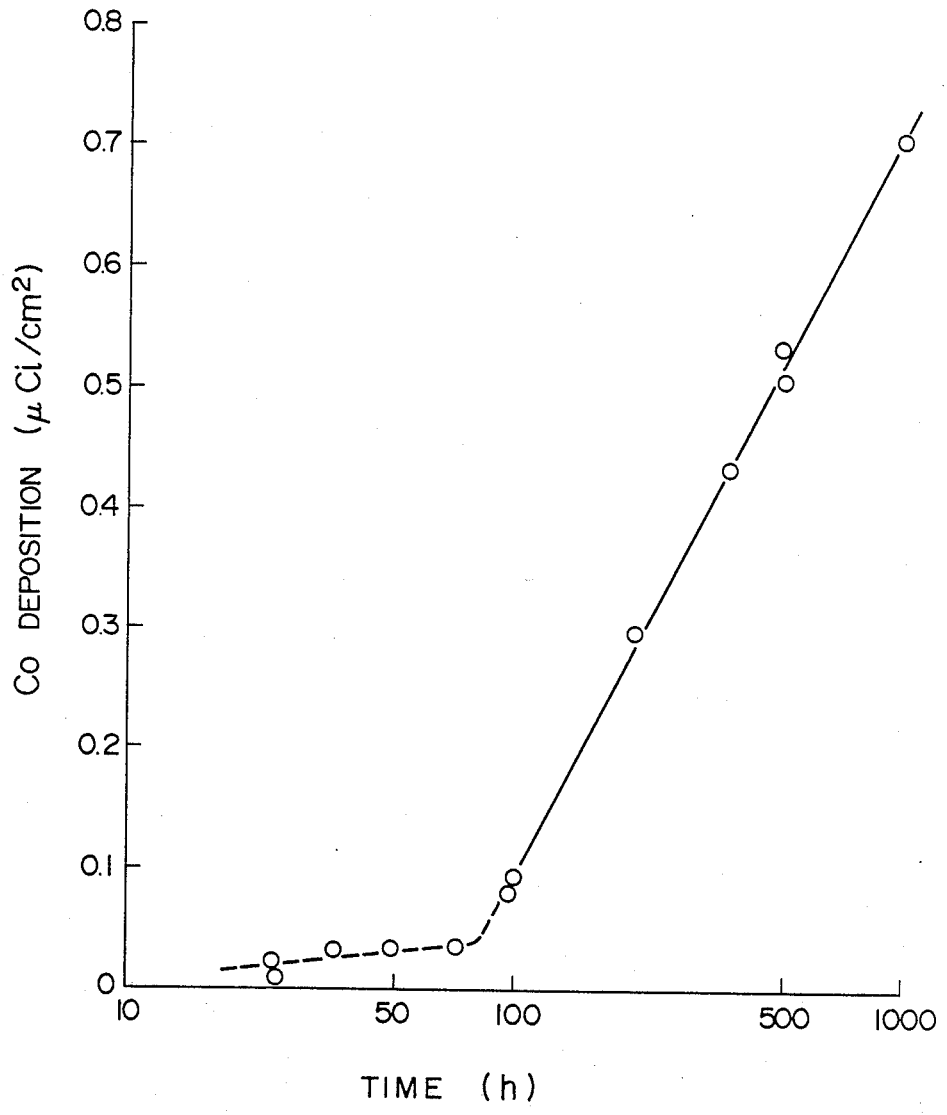
FIG. 8 is a graph showing a relationship between the $^{60}Co$ deposition amount and the time.

FIG. 8 shows the amount of $^{60}Co$ deposited with the lapse of time. As is clear from FIG. 8, the amount also increases according to a rule of logarithm after 100 hours as in the case of FIG. 7.

Therefore, FIGS. 7 and 8 clearly show that the deposition rate of $^{60}Co$ is rate-determined by the oxide film growth rate. Further, the growth rate of oxide film becomes smaller with the progress of growth.

Example 5

On the surface of the same stainless steel as used in Example 4, non-radioactive oxide films having a chromium content of 5.2 to 20.3% in the total metal elements were previously formed, respectively. Individual oxide films were immersed in the cooling water under the same conditions as described in Example 4 to measure the deposition rate of $^{60}Co$. The results are shown in Table 8 and FIG. 9.

TABLE 8

| Run No. | Composition of oxide film (%) Cr | Ni | Fe | Deposition rate of $^{60}Co$ (μCi/cm$^2$ · hr) |
|---|---|---|---|---|
| 1 | 5.2 | 4.9 | 89.9 | 0.27/t |
| 2 | 6.6 | 3.0 | 90.4 | 0.27/t |
| 3 | 7.9 | 2.8 | 89.4 | 0.27/t |
| 4 | 10.1 | 6.4 | 83.5 | 0.27/t |

TABLE 8-continued

| Run No. | Composition of oxide film (%) Cr | Ni | Fe | Deposition rate of $^{60}Co$ (μCi/cm$^2$ · hr) |
|---|---|---|---|---|
| 5 | 12.0 | 4.0 | 84.0 | 0.0562/t |
| 6 | 20.3 | 4.7 | 75.0 | 0.0984/t |

In Table 8, t is a total time in hour of the preoxidation treatment time and the immersion time in the cooling water.

Figure 9:
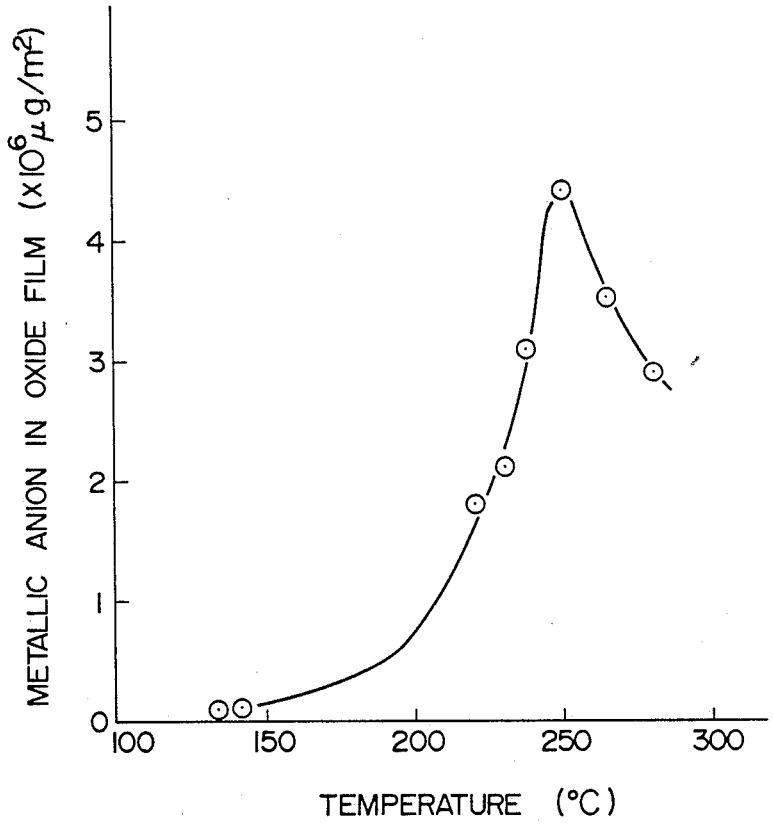
FIG. 9 is a graph showing a relationship between the treating temperature and the metal cation amount in an oxide film.

FIG. 9 shows the amount of oxide film formed when the stainless steel is subjected to oxidation treatment at 130° to 280° C. for 6000 hours. As is clear from FIG. 9, the formation of oxide film is accelerated at 150° C. or higher with an increase of the temperature, and particularly remarkably over 200° C. Therefore, the oxidation treatment temperature is particularly preferable over 200° C. The reactor water temperature in an operating BWR plant is 288° C., and the effective oxide film can be formed at such a temperature.

Figure 10:
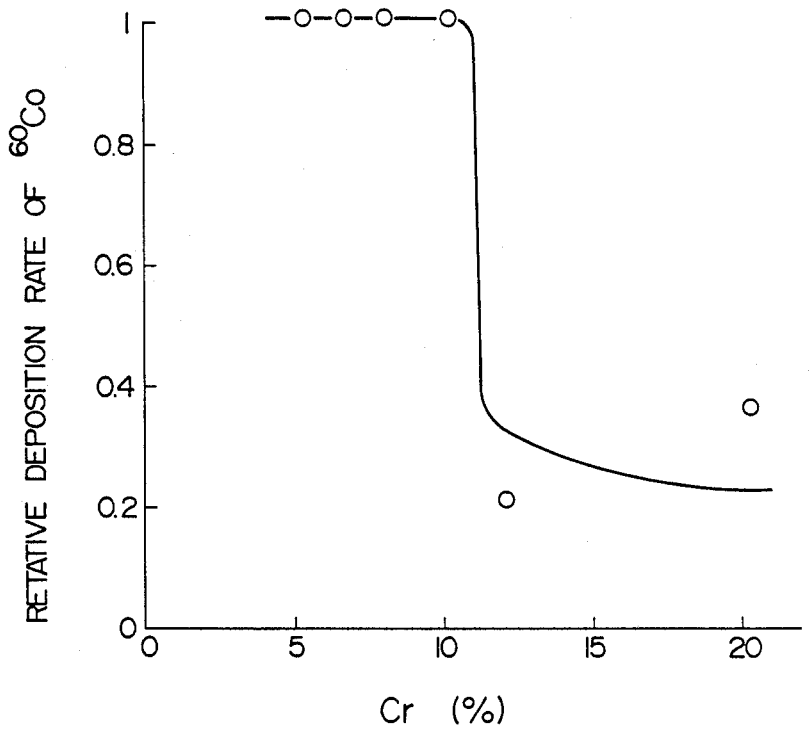
FIG. 10 is a graph showing a relationship between the relative deposition rate of $^{60}Co$ and the amount of Cr.

As is clear from Table 8 and FIG. 10, the deposition rate of $^{60}Co$ (dS/dt) is in inverse proportion to a total time (t) of the time required for previous oxidation treatment (the pre-oxidation treatment time, $t_0$) and the immersion time in the cooling water ($t_1$), and can be represented by the following equation in each case:

$$\frac{dS}{dt} = \frac{k}{t} = \frac{k}{t_0 + t_1} \quad (12)$$

wherein k is a constant depending on the kind of oxide film formed by the pre-oxidation treatment, and conditions such as $^{60}Co$ concentration in the solution dissolving radionuclides, temperatures, etc.

Therefore, in order to make the deposition rate of $^{60}Co$ small after immersion in the solution dissolving radionuclides under constant conditions, the pre-oxidation treatment time ($t_0$) is made larger, or alternatively proper pre-oxidation treatment conditions are selected so as to make the constant k smaller. But to make the pre-oxidation treatment time ($t_0$) larger is not advantageous from an industrial point of view, it is desirable to select an oxide film having a chromium content of 12% or more so as to make the constant k smaller and to reduce the deposition rate of $^{60}Co$.

Example 6

The same stainless steel as used in Example 4 was held in water containing a reducing agent as listed in Table 9 in an amount of 1000 ppm at 250° C. for 300 hours. The pH of water was adjusted to 7 with ammonia. The resulting oxide film formed on the surface of stainless steel was peeled off in an iodine-methanol solution and the chromium content in the oxide film was measured by conventional chemical analysis. The results are shown in Table 9.

As is clear from Table 9, oxide films having a very high chromium content were able to be obtained by the addition of a reducing agent. Particularly, the addition of a chelating agent such as Ni salt of EDTA or Ni salt of NTA makes the chromium content remarkably high.

TABLE 9

| Run No. | Reducing agent | Cr Content in oxide film (%) |
|---|---|---|
| 1 | None (pure water) | 19 |

TABLE 9-continued

| Run No. | Reducing agent | Cr Content in oxide film (%) |
|---|---|---|
| 2 | Hydrazine | 30 |
| 3 | Oxalic acid | 32 |
| 4 | Citric acid | 35 |
| 5 | EDTA—Ni | 63 |
| 6 | NTA—Ni | 55 |
| 7 | Hydrogen (saturated) | 28 |

Example 7

The same stainless steel as used in Example 4 was held in water containing 1000 ppm of EDTA at a temperature of 100° to 300° C. for 300 hours. The chromium content in the resulting oxide film was measured in the same manner as described in Example 6. The results are shown in Table 10.

TABLE 10

| Run No. | Temperature (°C.) | Cr Content in oxide film (%) |
|---|---|---|
| 1 | 100 | No oxide film was formed. |
| 2 | 150 | 70 |
| 3 | 200 | 79 |
| 4 | 250 | 63 |
| 5 | 300 | 58 |

As is clear from Table 10, when the temperature is 100° C. or lower, no oxide film is formed, so that the oxidation treatment is preferably conducted at 150° C. or higher.

Example 8

Stainless steel (SUS 304) the surface of which had been polished was subjected to oxidation treatment previously under the conditions as shown in Table 11. Then, the thus treated stainless steel was immersed in a $CoSO_4$ solution containing 50 ppb of $Co^{2+}$ ions at 285° C. (the same temperature as that of cooling water in a BWR plant) for 200 hours. The deposited Co amount was measured.

TABLE 11

| Run No | Solution | Concentration | Temperature (°C.) | Time (hrs) |
|---|---|---|---|---|
| 1* | $Ca(NO_3)_2$ | $Ca^{2+}$: 50 ppb | 230 | 100 |
| 2* | EDTA—Ni | 1000 ppm | 230 | 100 |
| 3* | NTA—Ni | 1000 ppm | 230 | 100 |
| 4 | $CaSO_4$ | $Ca^{2+}$: 50 ppb | 230 | 100 |
| 5 | Pure water ($O_2$: 200 ppb) | | 230 | 100 |
| 6 | No oxidation treatment was conducted. | | | |

Note
*This invention

The deposited amount of cobalt was evaluated by using an energy dispersing type X-ray analyzer (EDX) and obtaining Co/Fe ratios by dividing the peak strength of Co by the peak strength of Fe. The results are shown in Table 12.

TABLE 12

| Run No. | Co/Fe ratio |
|---|---|
| 1* | <0.1 |
| 2* | 0.1 |
| 3* | 0.1 |
| 4 | 0.5 |
| 5 | 0.6 |
| 6 | 1.5 |

Note
*This invention

As is clear from Tables 11 and 12, when the oxidation treatments were conducted as shown in Run Nos. 4 and 5, the deposited cobalt amount could be reduced to about ⅓ of that of Run No. 6 wherein no oxidation treatment was conducted, but the inhibition effect is not sufficient. In contrast, when the oxidation treatment was conducted as shown in Run Nos. 1 to 3 which belong to this invention, the deposition of cobalt was inhibited remarkably effectively.

In addition, when the oxidation treatment is conducted by using the solutions of Run Nos. 1 and 2 or Run Nos. 1 and 3, the more effective inhibition can be expected.

This invention can be applied to nuclear power plants as follows.

(1) In the case of re-use of piping and devices used in nuclear power plants after decontamination by the chemical method and the like, since the oxide film on the surfaces of components is dissolved and peeled off by the decontamination operation, the metal base is exposed and the depositing amount of radionuclides at the time of re-use shows the same change with the lapse of time as shown in FIG. 8. In such a case, when the oxidation treatment of this invention is applied before the re-use, the deposition of radioactive substances can be inhibited.

(2) This invention can be applied to any kinds of nuclear power plants. For example, in the case of BWR plant, a pressure vessel, re-circulation system piping and primary cooling water cleaning system piping, etc., contact with reactor water containing radioactive substances; and in the case of a pressurized water type nuclear power plant, a pressure vessel, components in a reactor, a vapor generator, etc., contact with the same reactor water as mentioned above. Therefore, by applying this invention to the whole or a part of components made of at least one metal selected from stainless steel, Inconel, carbon steel and, Stellite, the deposition of radioactive substances on the surfaces of components can be inhibited and it becomes possible to provide nuclear power plants wherein workers are by far less exposed to radioactive irradiation.

(3) The oxide film can be formed by this invention on surfaces of components contacting with the cooling water dissolving radioactive substances before or after the construction of nuclear power plants.

The oxidation treatment after enrichment of chromium content in the surface portion of the base metal can be conducted either before the construction of the plants, or after construction of the plants by introducing high-temperature water or hight-temperature steam.

(4) To already constructed plant piping and devices, this invention can be applied as follows.

Figure 11:
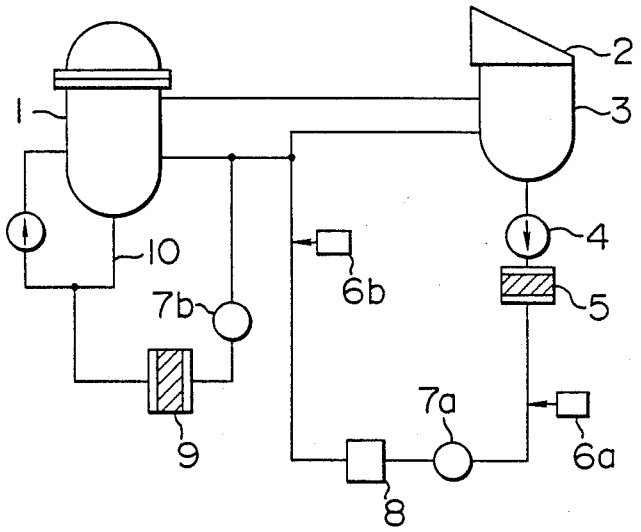
FIG. 11 is a flow sheet of a boiling water type nuclear power plant.

(a) In the case of a BWR plant as shown in FIG. 11, the solutions of compounds as shown in Example 2 or 6 can be poured into the primary cooling water using a pouring apparatus. In FIG. 11, numeral 1 denotes a reactor, numeral 2 a turbine, numeral 3 a hot well, numeral 4 a low pressure condensed water pump, numeral 5 a demineralizer for condensed water, numerals *6a* and *6b* are the abovementioned pouring apparatus, numerals 7*a* and 7*b* are dissolved oxygen concentration meters, numeral 8*a* supplying water heater, numeral 9 a demineralizer for reactor cleaning system, and numeral 10 a recirculation system. In this invention, the pouring apparatus can be attached to, for example, a down stream of the demineralizer for condensed water (5) in the condensed water system and/or a down stream of the supplying water heater (8) in the water supplying system. The pouring amount can be controlled by sampling the reactor water and measuring the concentration of polyvalent cations or oxygen concentration. Further, the cooling water can be sampled preferably at a position of inlet for reactor water cleaning 3.

(b) The pouring of polyvalent metal cations can be replaced by placing a metal which can release polyvalent metal cations in a solution. For example, a zinc, magnesium or aluminum plate is placed as a sacrificial anode in a condensate hot well 4 shown in FIG. 11. By this, $Zn^{2+}$, $Mg^{2+}$, or $Al^{3+}$ ions are released in the primary cooling water to increase the polyvalent metal cation concentration in the cooling water system and to obtain the same effect as obtained in (a) mention above. Further, this is also effective for preventing corrosion of the hot well 4. It is also effective to attach an alloy filter containing zinc, aluminum, etc., to a condensate cleaning system 5 or a cooling water cleaning system 6 shown in FIG. 11. By this, the same effect as obtained in (a) mentioned above as well as crud removing effect can be obtained.

What is claimed is:

1. A process for inhibiting deposition of radioactive substances on nuclear power plant components which comprises forming a positively charged oxide film on surface of components contacting with nuclear reactor cooling water containing radioactive substances by treating the surface of components with a solution containing anions and polyvalent metal cations, the anions having a lower valence number than the cations at a time of forming an oxide film or after the formation of the oxide film, wherein the polyvalent metal cations are at least one member selected from the group consisting of $Al^{3+}$, $Fe^{3+}$, $Ba^{2+}$, $Ca^{2+}$, $Co^{2+}$, $Mg^{2+}$, $Ni^{2+}$, $Pb^{2+}$, $Zn^{2+}$ and $Cu^{2+}$, and the anions are at least one member selected from the group consisting of $HCO_3^-$, $H_2PO_4^-$, $MnO_4^-$, $NO_2^-$, $NO_3^-$, $OH^-$, $HCOO^-$, $CH_3COO^-$, $MnO_4^{2-}$, $HPO_4^{2-}$, $SO_4^{2-}$ and $WO_4^{2-}$.

2. A process according to claim 1, wherein the solution containing the polyvalent metal cations and the anions has a temperature of 150° to 300° C.

3. A process according to claim 1, wherein the polyvalent metal cations are used in a concentration of 3 ppb to 1000 ppm.

4. A process according to claim 1, wherein said polyvalent metal cations are selected from the group consisting of $Al^{3+}$, $Fe^{3+}$, $Ba^{2+}$, $Ca^{2+}$, $Co^{2+}$, $Mg^{2+}$, $Ni^{2+}$, $Pb^{2+}$, $Zn^{2+}$ and $Cu^{2+}$, and wherein the anions are selected from the group consisting of $HCO_3^-$, $H_2PO_4^-$, $MnO_4^-$, $NO_2^-$, $NO_3^-$, $OH^-$, $HCOO^-$ and $CH_3COO^-$.

5. A process according to claim 1, wherein said polyvalent metal cations are selected from the group consisting of $Al^{3+}$ and $Fe^{3+}$, and wherein the anions are selected from the group consisting of $MoO_4^{2-}$, $HPO_4^{2-}$, $SO_4^{2-}$ and $WO_4^{2-}$.

6. A process according to claim 3, wherein the positively charged iron oxide film is formed to have a thickness of at least 300 Å.

7. A process according to claim 1, wherein the components are formed of materials selected from the group consisting of stainless steel; carbon steel; cobalt-chromium-tungsten alloy; and nickel-chromium-iron alloy.

8. A process according to claim 7, wherein the components are formed of carbon steel.

9. A process according to claim 7, wherein the components are formed of materials selected from the group consisting of cobalt-chromium-tungsten alloy and nickel-chromium-iron alloy.

10. A process according to claim 1, wherein said treating is performed by pouring said solution into said cooling water, whereby solution-containing cooling water treats the surfaces of the components.

11. A process according to claim 10, wherein said surfaces of components are made of stainless steel.

12. A process for inhibiting deposition of radioactive substances on nuclear power plant components which comprises forming a positively charged iron oxide film containing metallic elements giving polyvalent metal cations and chromium on surfaces of components contacting with nuclear reactor cooling water containing radioactive substances, the positively charged iron oxide film being formed by contacting said surfaces of components with a solution containing said polyvalent metal cations and anions having a lower valence number than the cations, wherein the polyvalent metal cations are at least one member selected from the group consisting of $Al^{3+}$, $Fe^{3+}$, $Ba^{2+}$, $Ca^{2+}$, $Co^{2+}$, $Mg^{2+}$, $Ni^{2+}$, $Pb^{2+}$, $Zn^{2+}$ and $Cu^{2+}$, and the anions are at least one member selected from the group consisting of $HCO_3^-$, $H_2PO_4^-$, $MnO_4^-$, $NO_2^-$, $NO_3^-$, $OH^-$, $HCOO^-$, $CH_3COO^-$, $MnO_4^{2-}$, $HPO_4^{2-}$, $SO_4^{2-}$ and $WO_4^{2-}$.

13. A process according to claim 12, wherein the chromium content in the iron oxide film is 12% by weight or more.

14. A process according to claim 12, wherein the polyvalent metal cations are used in a concentration of 3 ppb to 1000 ppm.

15. A process according to claim 14, wherein the components are made of stainless steel.

16. A process according to claim 15, wherein the solution has a temperature of 150° to 300° C.

17. A process for inhibiting deposition of radioactive substances on nuclear power plant components made of an iron series material and contacting with reactor cooling water containing radioactive substances, which comprises treating surfaces of components made of a chromium-containing iron series material with heated water or heated steam to form an oxide film containing chromium in an amount of 12% by weight or more. formed thereon, prior to operation of the plant to provide nuclear heating, the oxide film having a chromium content of at least 12% by weight, wherein said oxide film is a positively charged oxide film, formed by contacting said surfaces with a solution containing polyvalent metal cations and anions having a lower valence number than the cations.

18. A process according to claim 17, further comprising the step of treating said surfaces of components with a solution containing polyvalent metal cations and anions having a lower valence number than the cations so as to form a positively charged iron oxide film on said surfaces of components, whereby said surfaces have a positively charged iron oxide film and an oxide film containing chromium in an amount of 12% by weight or more.

19. A process according to claim 18, wherein the polyvalent metal cations are at least one member selected from the group consisting of $Al^{3+}$, $Fe^{3+}$, $Ba^{2+}$, $Ca^{2+}$, $Mg^{2+}$, $Ni^{2+}$, $Pb^{2+}$, $Zn^{2+}$ and $Cu^{2+}$, and the anions are at least one member selected from the group consisting of $HCO_3^-$, $H_2PO_4^-$, $MnO_4^-$, $NO_2^-$, $NO_3^-$, $OH^-$, $HCOO^-$, $CH_3COO^-$, $MnO_4^{2-}$, $HPo_4^{2-}$, $SO_4^{2-}$ and $WO_4^{2-}$.

20. A process according to claim 19, wherein the polyvalent metal cations are used in a concentration of 3 ppb to 1000 ppm.

21. A process according to claim 20, wherein the heated water or the heated steam contains a reducing agent.

22. A process according to claim 17, wherein the heated water has a temperature of 150° to 300° C.

23. A process according to claim 17, wherein the heated steam has a temperature of 150° to 1000° C.

24. A process according to claim 17, wherein said surfaces are a coating of chromium or chromium-containing iron series material, said coating being a chromium plated film, chromizing treated film or chromium vapor deposited film.

25. A process according to claim 17, wherein the components are formed of materials selected from the group consisting of stainless steel; carbon steel; and cobalt-chromium-tungsten alloy; and nickel-chromium-iron alloy.

26. A process according to claim 25, wherein the components are formed of carbon steel.

27. A process according to claim 25, wherein the components are formed of materials selected from the group consisting of cobalt-chromium-tungsten alloy and nickel-chromium-iron alloy.

28. A process according to claim 21, wherein the reducing agent is also a chelating agent.

29. A process according to claim 21, wherein the reducing agent is a Ni salt of ethylenediamine-tetraacetic acid or a nickel salt of nitrilotriacetic acid.

30. In a nuclear power plant comprising a reactor, a turbine, a condenser, a condensed water demineralizer, a supplying water heater, a demineralizer for a reactor cleaning system, and a reactor re-circulation piping system, the improvement wherein a positively charged iron oxide film is formed on surfaces which contact with nuclear reactor cooling water in said plant, the positively charged iron oxide film being formed by contacting said surfaces with a solution containing polyvalent metal cations and anions having a lower valence number than the cations.

31. A nuclear power plant according to claim 30, wherein the polyvalent metal cations are at least one member selected from the group consisting of $Al^{3+}$, $Fe^{3+}$, $Ba^{2+}$, $Co^{2+}$, $Mg^{2+}$, $Ni^{2+}$, $Pb^{2+}$, $Zn^{2+}$ and $Cu^{2+}$, and the anions are at least one member selected from the group consisting of $HCO_3^-$, $H_2PO_4^-$, $MnO_4^-$, $NO_2^-$, $NO_3^-$, $OH^-$, $HCOO^-$, $CH_3COO^-$, $MnO_4^{2-}$, $HPO_4^{2-}$, $SO_4^{2-}$ and $WO_4^{2-}$.

32. In a nuclear power plant comprising a reactor, a turbine, a condenser, a condensed water demineralizer, a supplying water heater, a demineralizer for a reactor cleaning system, and a reactor re-circulation piping system, the improvement wherein a positively charged iron oxide film is formed on surfaces which contact with nuclear reactor cooling water in said plant, the positively charged iron oxide film being formed by contacting said surfaces with a solution containing polyvalent metal cations and anions having a lower valence number than the cations, after the construction of said plant and prior to the operation thereof to provide nuclear heating.

33. A nuclear power plant according to claim 32, wherein the polyvalent metal cations are at least one member selected from the group consisting of $Al^{3+}$, $Fe^{3+}$, $Ba^{2+}$, $Ca^{2+}$, $Co^{2+}$, $Mg^{2+}$, $Ni^{2+}$, $Pb^{2+}$, $Zn^{2+}$ and $Cu^{2+}$, and the anions are at least one member selected from the group consisting of $HCO_3^-$, $H_2PO_4^-$, $MnO_4^-$, $NO_2^-$, $NO_3^-$, $OH^-$, $HCOO^-$, $CH_3COO^-$, $MnO_4^{2-}$, $HPO_4^{2-}$, $SO_4^{2-}$ and $WO_4^{2-}$.

34. In a nuclear power plant comprising a reactor, a turbine, a condenser, a condensed water demineralizer, a supplying water heater, a demineralizer for a reactor cleaning system, and a reactor re-circulation piping system, the improvement wherein a positively charged iron oxide film is formed on surfaces which contact with nuclear reactor cooling water contaminated with radioactive substances after the operation of said plant, the positively charged iron oxide film being formed by contacting said surfaces with a solution containing polyvalent metal cations and anions having a lower valence number than the cations.

35. A nuclear power plant according to claim 34, wherein the polyvalent metal cations are at least one member selected from the group consisting of $Al^{3+}$, $Fe^{3+}$, $Ba^{2+}$, $Ca^{2+}$, $Co^{2+}$, $Mg^{2+}$, $Ni^{2+}$, $Pb^{2+}$, $Zn^{2+}$ and $Cu^{2+}$, and the anions are at least one member selected from the group consisting of $HCO_3^-$, $H_2PO_4^-$, $MnO_4^-$, $NO_2^-$, $NO_3^-$, $OH^-$, $HCOO^-$, $CH_3COO^-$, $MnO_4^{2-}$, $HPO_4^{2-}$, $SO_4^{2-}$ and $WO_4^{2-}$.

36. In a nuclear power plant comprising a reactor, a turbine, a condenser, a condensed water demineralizer, a supplying water heater, a demineralizer for a reactor cleaning system, and a reactor re-circulation piping system, the improvement wherein surfaces of the plant which contact with nuclear reactor cooling water have an oxide film formed thereon, prior to operation of the plant to provide nuclear heating, the oxide film having a chromium content of at least 12% by weight, wherein said oxide film is a positively charged oxide film, formed by contacting said surfaces with a solution containing polyvalent metal cations and anions having a lower valence number than the cations.

* * * * *